US005099739A

United States Patent [19]

Adachi

[11] Patent Number: 5,099,739

[45] Date of Patent: Mar. 31, 1992

[54] MUSICAL TONE GENERATING APARATUS

[75] Inventor: Takeshi Adachi, Hamamatsu, Japan

[73] Assignee: Yamaha Corporation, Hamamatsu, Japan

[21] Appl. No.: 240,754

[22] Filed: Sep. 2, 1988

[30] Foreign Application Priority Data

Sep. 5, 1987 [JP] Japan ..... 62-222654

[51] Int. Cl.[5] ..... G10M 7/00

[52] U.S. Cl. ..... 84/622; 84/602; 84/604; 84/626; 84/DIG. 27; 381/1; 381/17

[58] Field of Search .... 84/DIG. 1, DIG. 9, DIG. 27, 84/1.19-1.23, 1.13, 1.26, 1.01, 1.03, 602-604, 606, 615, 622, 626, 627, 630, 631, 600, DIG. 4, DIG. 26; 381/17, 18, 1

[56] References Cited

U.S. PATENT DOCUMENTS 3,882,751 5/1975 Tomisawa et al. ..... 84/1.19 X
4,239,939 12/1980 Griffis ..... 381/17
4,569,268 2/1986 Futamase et al. ..... 84/631 X
4,577,540 3/1986 Yamana ..... 84/665
4,584,921 4/1986 Wachi ..... 84/1.01
4,602,546 7/1986 Shinohara ..... 84/622 X
4,622,878 11/1986 Sharp ..... 84/DIG. 27
4,679,480 7/1987 Suzuki ..... 84/DIG. 9
4,701,956 10/1987 Katoh ..... 84/DIG. 9
4,703,680 11/1987 Wachi et al. ..... 84/1.26
4,706,537 11/1987 Oguri ..... 84/1.26 X
4,738,179 4/1988 Suzuki ..... 84/DIG. 9
4,841,828 6/1989 Suzuki ..... 84/DIG. 9
4,843,938 7/1989 Suzuki ..... 84/DIG. 9

*Primary Examiner*—A. T. Grimley
*Assistant Examiner*—Matthew S. Smith
*Attorney, Agent, or Firm*—Graham & James

[57] ABSTRACT

The musical tone generating apparatus includes at least a waveform memory for storing waveform data, a stereophonic effect giving portion, left and right sound systems. The stereophonic effect giving portion gives stereophonic effect to the waveform data read from the waveform memory so that the left and right sound systems can generate left and right musical tones respectively based on the same waveform data outputted from the stereophonic effect giving portion. This stereophonic effect giving portion includes at least one digital filter whose filter coefficient can be adequately selected. This digital filter filters out the waveform data, and then the filtered waveform data are supplied to one of the left and right sound systems so that frequency characteristic of the left musical tone will be different from that of the right musical tone. Meanwhile, two digital filters can be provided at both inputs of the left and right sound systems.

18 Claims, 7 Drawing Sheets

MUSICAL TONE GENERATING APARATUS

BACKGROUND OF THE INVENTION

1. Field of the Invention

The present invention relates to a musical tone generating apparatus, and more particularly to a musical tone generating apparatus by which a technique for giving stereophonic effect can be improved.

2. Prior Art

As a conventional electronic musical instrument capable of demonstrating the stereophonic effect, the electronic musical instrument disclosed in Japanese Patent Laid-Open Publication No. 61-97698 is known. In this electronic musical instrument, a single tone performed by a non-electronic musical instrument (or acoustic musical instrument) such as a piano is picked up at its specific pick-up position, and then waveform data thereof are stored in a waveform memory by every pick-up tone. When tone pitch corresponding to the above-mentioned single tone is designated, the waveform data of plural tones are read from the waveform memory in parallel and then supplied to plural sound systems corresponding to the pick-up positions, so that plural pick-up tones can be simultaneously reproduced.

According to the above-mentioned conventional technique, the waveform memory stores plural waveforms by single tone. For this reason, as number of the pick-up positions becomes large, data quantity to be stored must become enormous. Therefore, there is a disadvantage in that the waveform memory having large storage capacity or a plenty of waveform memories must be needed.

SUMMARY OF THE INVENTION

It is accordingly a primary object of the present invention to provide a musical tone generating apparatus by which the stereophonic effect can be obtained with relatively small memory capacity.

In a first a aspect of the invention, there is provided musical tone generating apparatus comprising:

(a) waveform memory means for storing several kinds of waveform data of musical tones to be generated in advance;

(b) reading means for reading out desirable waveform data from the waveform memory means by desirable speed; and (c) stereophonic effect giving means for giving stereophonic effect to the desirable waveform data read from the waveform memory means so that left and right musical tones will be generated.

In a second aspect of the invention, there is provided a musical tone generating apparatus comprising:

(a) storing means for storing digitized waveform information concerning a musical tone;

(b) reading means for reading the waveform information from the storing means by desirable speed;

(c) first tone generating means for generating a first musical tone based on the waveform information read from the storing means;

(d) digital filter means for inputting the waveform information read from the storing means;

(e) second tone generating means for generating a second musical tone based on the waveform information outputted from the digital filter means at substantially same timing when the first musical tone is generated; and (f) control means for controlling a filter coefficient of the digital filter means so that frequency characteristic of the first musical tone will be different from that of the second musical tone.

In a third aspect of the invention, there is provided a musical tone generating apparatus comprising:

(a) storing means for storing digitized waveform information concerning a musical tone;

(b) reading means for reading the waveform information from the storing means by desirable speed;

(c) first and second digital filter means each inputting the waveform information read from the storing means;

(d) first tone generating means for generating a first musical tone based on the waveform information outputted from the first digital filter means;

(e) second tone generating means for generating a second musical tone based o the waveform information outputted from the second digital filter means at substantially same timing when the first musical tone is generated; and (f) control means for controlling filter coefficients of the first and second digital filter means so that frequency characteristic of the first musical tone will be different from that of the second musical tone.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF A PREFERRED EMBODIMENT

[A] Outline of the Invention

The present invention relates to a musical tone generating apparatus which reads the waveform data from the waveform memory and then conducts such waveform data to plural sound systems to thereby generate musical tones in parallel. More specifically, a digital filter is arranged in a line of waveform data which is connected to at least one sound system. In this case, plural tones having different frequency characteristics are simultaneously generated based on waveform information of single tone. Therefore, coefficients of the digital filter are controlled so that frequency characteristics of the generated musical tones will be different from each other, i.e., plural tones will be accompanied with desirable stereophonic feelings. Thus, it is possible to obtain the stereophonic effect without storing the waveform information of plural tones which must be stored in the conventional apparatus, so that it is possible to reduce the memory capacity.

Figure 1:
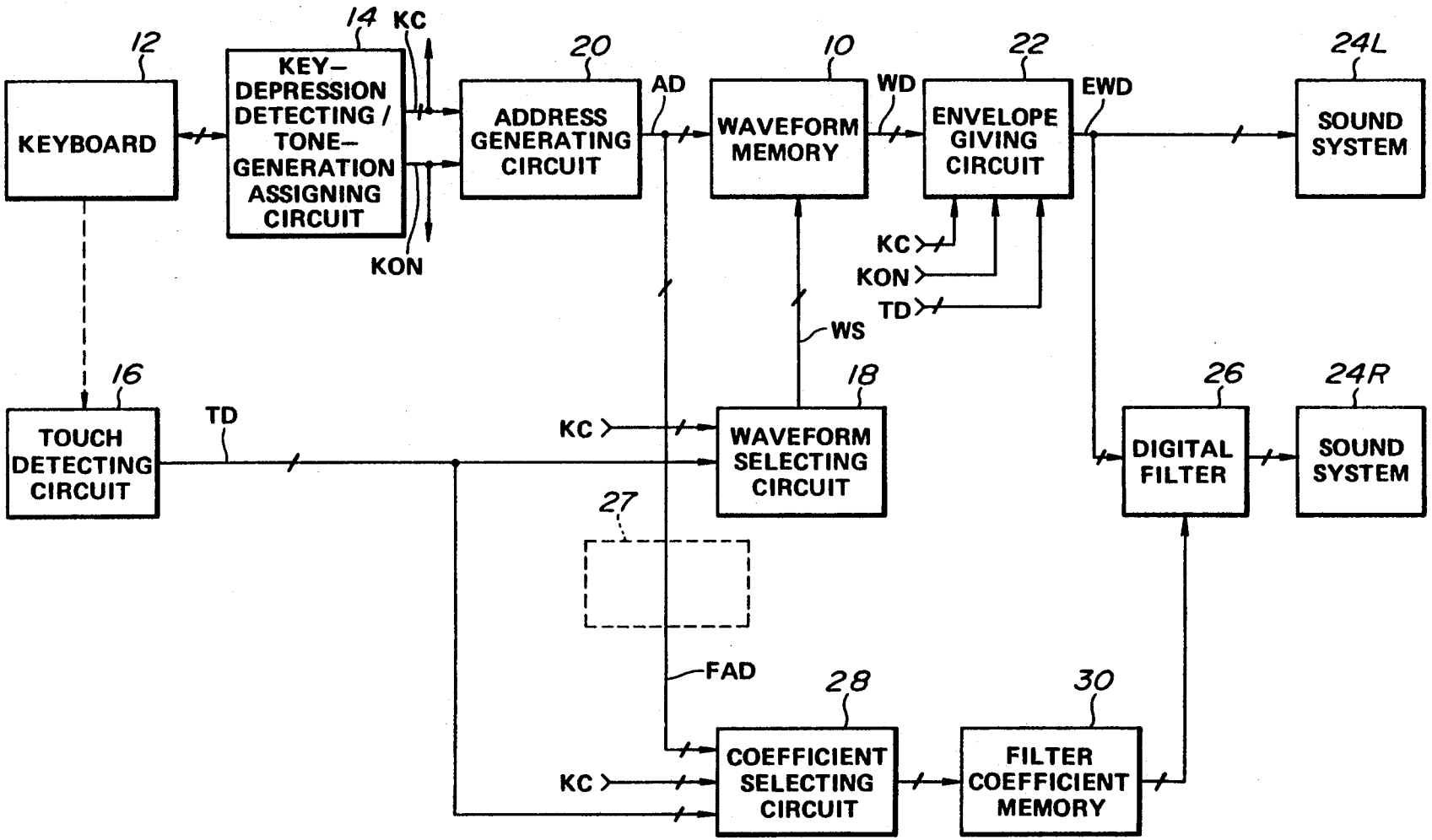
FIG. 1 is a block diagram showing whole constitution of an electronic musical instrument according to an embodiment of the present invention.

[B] Circuit Constitution of Electronic Musical Instrument (FIG. 1)

Next, detailed description will be given with respect to an embodiment of the present invention by referring to the drawings, wherein like reference characters designate like or corresponding parts throughout the several views. In FIGS. 1 to 3 and FIGS. 6 to 8, a signal line added with an oblique line "/" (such as a signal line of "KC" shown in FIG. 1) may include plural signal lines or designate flow of a signal of plural bits.

FIG. 1 shows the circuit constitution of the electronic musical instrument according to an embodiment of the present invention. This electronic musical instrument is designed so that plural tones can be simultaneously generated by time division process of plural channels (e.g., eight channels).

In FIG. 1, plural keys of a keyboard 12 are divided into some key groups each including half octave keys (i.e., six keys), and a waveform memory 10 stores the waveform data corresponding to one key representing each key group. In the present embodiment, the waveform memory 10 stores such waveform data of some key-touch intensity levels (e.g., three levels indicative of weak, middle and strong key-touch intensities). The reason why the waveform data are stored by every key group as described above is to enable key scaling control so that tone color and the like can be differed in response to each key group. In addition, the reason why the waveform data are stored by every key-touch intensity level is to enable touch response control so that the tone color, tone volume and the like can be differed in response to the key-touch intensity level. Further, the waveform memory 10 stores the waveform data representative of performance tones of piano (as non-electronic musical instrument), for example. Detailed description concerning the method for storing such waveform data will be described later.

A key-depression detecting/tone-generation assigning circuit 14 detects a depressed key within the keyboard 12 and then assigns key code data KC (representative of a key code or tone pitch of the detected key) and a key-on signal KON (representing that there exists the depressed key) to a vacant channel thereof. These data are outputted by a timing of such assigned vacant channel.

A touch detecting circuit 16 detects which of the weak, middle and strong key-touch intensity levels (or touch levels) the depressed key within the keyboard 12 corresponds to. Then, the touch detecting circuit 16 outputs touch level data TD indicative of the detected touch level in synchronism with the timing of the channel to which the above-mentioned data KC and signal KON are assigned.

As described above, these two circuits 14 and 16 operate based on the time division system, hence, latter circuits connecting to and responding to the outputs of these circuits also operate based on the time division system. In the following description, description will be given with respect to the operation of only one channel for convenience.

A waveform selecting circuit 18 generates waveform designating data WS in response to the key code data KC and the touch level data TD. In response to this waveform designating data WS, the waveform data to be read from the waveform memory 10 are designated. For example, when the key code indicated by the key code data KC belongs to a first key group, the waveform data corresponding to the touch level indicated by the touch level data TD are read out and designated from several waveform data corresponding to this first key group.

An address generating circuit 20 generates an address signal AD in response to the key code data KC and the key-on signal KON. In accordance with this address signal AD, the waveform data designated by the waveform designating data WS are read from the waveform memory 10. In this case, such address designation by the address signal AD is executed at a speed corresponding to the key code (or tone pitch) indicated by the key code data KC. Thus, the tone pitch of the generated musical tone is determined in response to reading speed at this time. Meanwhile, plural keys belongs to the same one key group, however, the same waveform data are read out by every key at different reading speed in the case where the keys in one key group are depressed by constant touch level.

An envelope giving circuit 22 gives an amplitude envelope to waveform data WD read from the waveform memory 10. This envelope giving circuit 22 is constituted by an envelope generator and a multiplier. The envelope generator generates envelope waveform data indicative of the envelope whose level rises up in response to the key-on signal KON and then attenuates, for example. The multiplier multiplies the generated envelope waveform data by the waveform data WD. In this case, the key code data KC and the touch level data TD are used for determining envelope characteristics such as attack time, attack level, decay time and the like. As the above-mentioned envelope generator, it is possible to adopt an envelope generator which includes an envelope memory and a reading circuit. This envelope memory stores the envelope waveform data corresponding to each waveform data pre-stored in the waveform memory 10. The reading circuit reads the envelope waveform data designated by the key code data KC and the touch data TD from the envelope memory. According to needs, it is possible to adopt a digital operation type envelope generator.

The above-mentioned envelope giving circuit 22 outputs waveform data EWD, which are supplied to a sound system 24L for left channel and also supplied to a sound system 24R for right channel via a digital filter 26. Both of the sound systems 24L and 24R generate musical tones based on the supplied waveform data. As known well, such sound system can be constituted by use of an accumulator, a digital-to-analog (D/A) converter, an amplifier and a speaker etc., for example.

A coefficient selecting circuit 28 selects and reads out one of many filter coefficients stored in a filter coefficient memory 30. More specifically, this coefficient selecting circuit 28 selectively reads out the filter coefficient in response to a frame address signal FAD constituted by upper-bit signal of the address signal AD, the key code data KC and the touch level data TD.

The filter coefficient memory 30 stores the filter coefficients of plural frames by every waveform data stored in the waveform memory 10, but description concerning the storing method and reading operation thereof will be given later.

The filter coefficient read from the filter coefficient memory 30 is supplied to the digital filter 26, which is constituted by the known FIR digital filter or IIR digital filter. This digital filter 26 controls to vary spectrum distribution of the waveform data EWD in response to the supplied filter coefficient.

Figure 2:
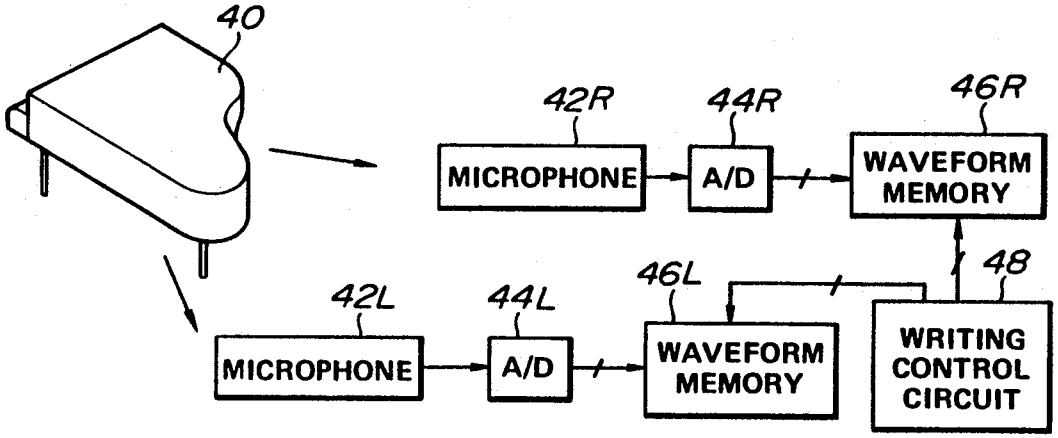
FIGS. 2 and 3 are block diagrams respectively showing a musical tone waveform storing unit and a filter coefficient writing unit used in the electronic musical instrument shown in FIG. 1.

[C] Musical Tone Waveform Storing Unit (FIG. 2)

FIG. 2 shows the musical tone waveform storing unit which is used when the waveform memory 10 stores the waveform data in the above-mentioned electronic musical instrument.

Figure 4:
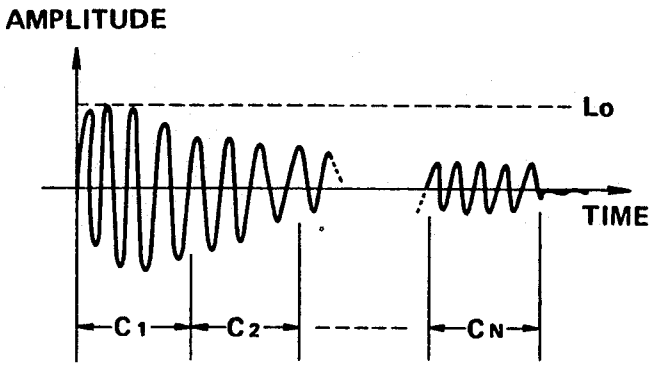
FIG. 4 shows a waveform representative of an example of a pick-up tone waveform in the musical tone waveform storing unit shown in FIG. 2.

In the vicinity of a piano 40, right microphone 42R and left microphone 42L are provided in order to pick up the performance tone of the piano 40. Tone signal picked up by the right microphone 42R has a waveform as shown in FIG. 4, for example. This tone signal is supplied to an analog-to-digital (A/D) converter 44R wherein pick-up tone waveform is sampled by predetermined time interval and an amplitude value at each sample point is converted into digital data. Such digital data are sequentially supplied to a waveform memory 46R as the waveform data. Thus, the waveform data corresponding to the pick-up tone are written into the waveform memory 46R under control of a writing control circuit 48. Similarly, the tone signal picked up by the left microphone 42L is converted into the waveform data by an A/D converter 44L, and then such waveform data are written into a waveform memory 46L under control of the writing control circuit 48. After all, the musical tone waveform storing unit shown in FIG. 2 works as a pulse code modulation (PCM) recording unit of two channels (i.e., left and right channels).

In the actual recording, the keys within the piano 40 are subjected to grouping in response to the key groups of the keyboard 12 shown in FIG. 1. One key representing each key group is depressed by different touch levels (i.e., weak, middle and strong touch levels) so that piano tones are generated. As a result, the waveform memory 46R stores right pick-up tone waveforms corresponding to three touch levels by each key group. Similarly, the waveform memory 46L stores left pick-up tone waveforms corresponding to three touch levels by each key group.

The waveform data stored in &he waveform memory 46L for left channel are transferred and then stored in the waveform memory 10 shown in FIG. 1. In this case, the waveform between rising point and middle of attenuating portion of each pick-up tone waveform is divided into N frames (where one frame is set as 10 msec, for example) such as divisions $C_l$ to $C_N$ along time axis of the graph shown in FIG. 4. The waveform data corresponding to the divisions $C_l$ to $C_N$ are stored in the waveform memory 10, but the waveform data corresponding to the attenuating portion of the waveform after the division $C_N$ are not stored in the waveform memory 10. Thus, when the waveform data are read from the waveform memory 10, the waveform data corresponding to the division $C_N$ are repeatedly read out after such waveform data are read out.

Incidentally, when the waveform data are stored in the waveform memory 10, it is possible to store the waveform data which are obtained by standardizing the amplitude level of each pick-up tone waveform to a constant level $L_O$ such as the maximum level and the like, for example. Thus, it is possible to digitize the amplitude value in lower amplitude portion of the waveform with. In this case, there is no problem occurred due to the above-mentioned standardization because the envelope giving circuit 22 gives the amplitude envelope to the waveform data as described before.

Figure 3:
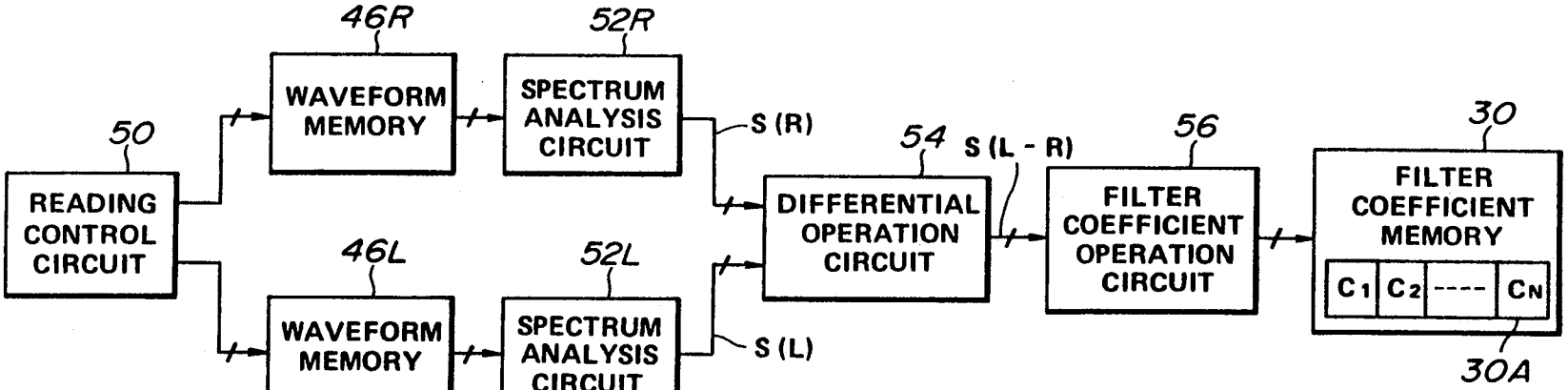

[D] Filter Coefficient Writing Unit (FIG. 3)

FIG. 3 shows the filter coefficient writing unit which is used when the filter coefficients are stored in the filter coefficient memory 30 in the electronic musical instrument shown in FIG. 1. In FIG. 3, the waveform data have been already written into the waveform memories 46R and 46L as described in FIG. 2. The waveform data corresponding to the divisions $C_l$ to $C_N$ are read from each waveform memory by each pick-up tone waveform under control of a reading control circuit 50. The waveform data read from each of the waveform memories 46R and 46L are supplied to each of spectrum analysis circuits 52R and 52L.

Each of the spectrum analysis circuits 52R and 52L effects the spectrum analysis on each of the frames $C_l$ to $C_N$ by each pick-up tone waveform to thereby output spectrum analysis outputs S(R) and S(L) respectively, both of which are supplied to a differential operation circuit 54.

Figure 5A:
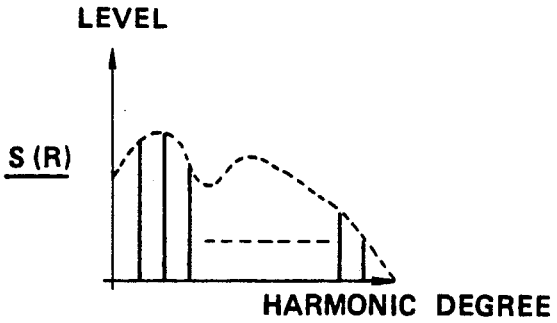
FIGS. 5A to 5C are spectrum diagrams showing an example of spectrum analysis of one frame in the filter coefficient writing unit shown in FIG. 3.
Figure 5B:
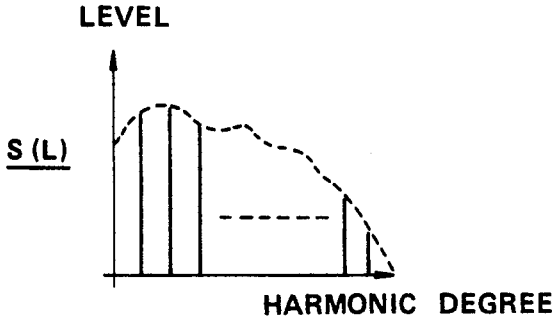
Figure 5C:
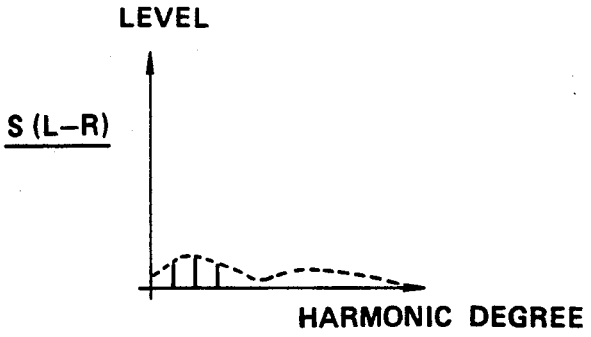

Each of FIGS. 5A to 5C shows an example of spectrum analysis of one frame. The spectrum analysis circuit 52R effects the spectrum analysis on the right pick-up tone waveform of one frame to thereby generate the spectrum analysis output S(R) as shown in FIG. 5A, while the spectrum analysis circuit 52L effects the spectrum analysis on the left pick-up tone waveform of one frame to thereby generate the spectrum analysis output S(L) as shown in FIG. 5B.

The differential operation circuit 54 subtracts the spectrum analysis output S(R) from the spectrum analysis output S(L) by each frame to thereby generate a differential spectrum output S(L-R) which corresponds to the differential of two outputs S(L) and S(R). This differential spectrum output S(L-R) is supplied to a filter coefficient operation circuit 56. S(L-R) shown in FIG. 5C designates an example of the difference spectrum output between the spectrum analysis outputs S(L) and S(R).

The filter coefficient operation circuit 56 calculates out the filter coefficient based on the differential spectrum output S(L-R) by each frame. Then, the calculated filter coefficient is written into the filter coefficient memory 30.

The filter coefficient memory 30 provides storing areas 30A of (key group number)×(touch level number, i.e., three in the present embodiment), each of which includes N storing portions in order to write the filter coefficients respectively corresponding to the frames $C_l$ to $C_N$ therein. As described above, the spectrum analysis and the filter coefficient operation are effected on one pair of left and right pick-up tone waveforms by every frame, so that the filter coefficients of N frames can be stored in each storing area 30A.

In order to read the filter coefficients from the filter coefficient memory 30, the coefficient selecting circuit 28 designates the storing area to be read out in response to the key code data KC and the touch level data TD. Then, the filter coefficients corresponding to the frames $C_l$ to $C_N$ are sequentially read from the designated storing area in response to the frame address signal FAD. In this case, this frame address signal FAD is constituted by upper-bit signal within the address signal AD. When the address signal AD designates the address of the waveform of specific frame, the address of the filter coefficient corresponding to this specific frame is designated. As a result, while the waveform data of the frame $C_l$ are read out, the filter coefficient corresponding to this frame $C_l$ is read from the filter coefficient memory 30 and then supplied to the digital filter 26, for example.

Therefore, in accordance that the waveform data indicative of the left pick-up tone waveform are read from the waveform memory 10, the filter coefficients corresponding to the frames $C_l$ to $C_N$ are sequentially supplied to the digital filter 26. Thus, the waveform data passing through the digital filter 26 are given with the spectrum distribution similar to that of the right pick-up tone waveform by each frame. As a result, the musical tones generated from the sound systems 24L and 24R will perform the stereophonic effect.

In the above description, the lengths of the frames $C_l$ to $C_N$ are set equal to each other. However, it is possible to set these frame lengths different from each other. In the case where the frame lengths are set different from each other, it is necessary to provide a frame address generating circuit 27 which inputs the address signal AD and then generates the frame address signal FAD as shown by dotted line in FIG. 1. This frame address generating circuit 27 compares the address signal AD to end address of waveform data by each frame. At every time when it is detected that the address signal AD coincides with the end address of waveform data, this circuit 27 generates the frame address signal FAD so as to designate the next frame.

Figure 6:
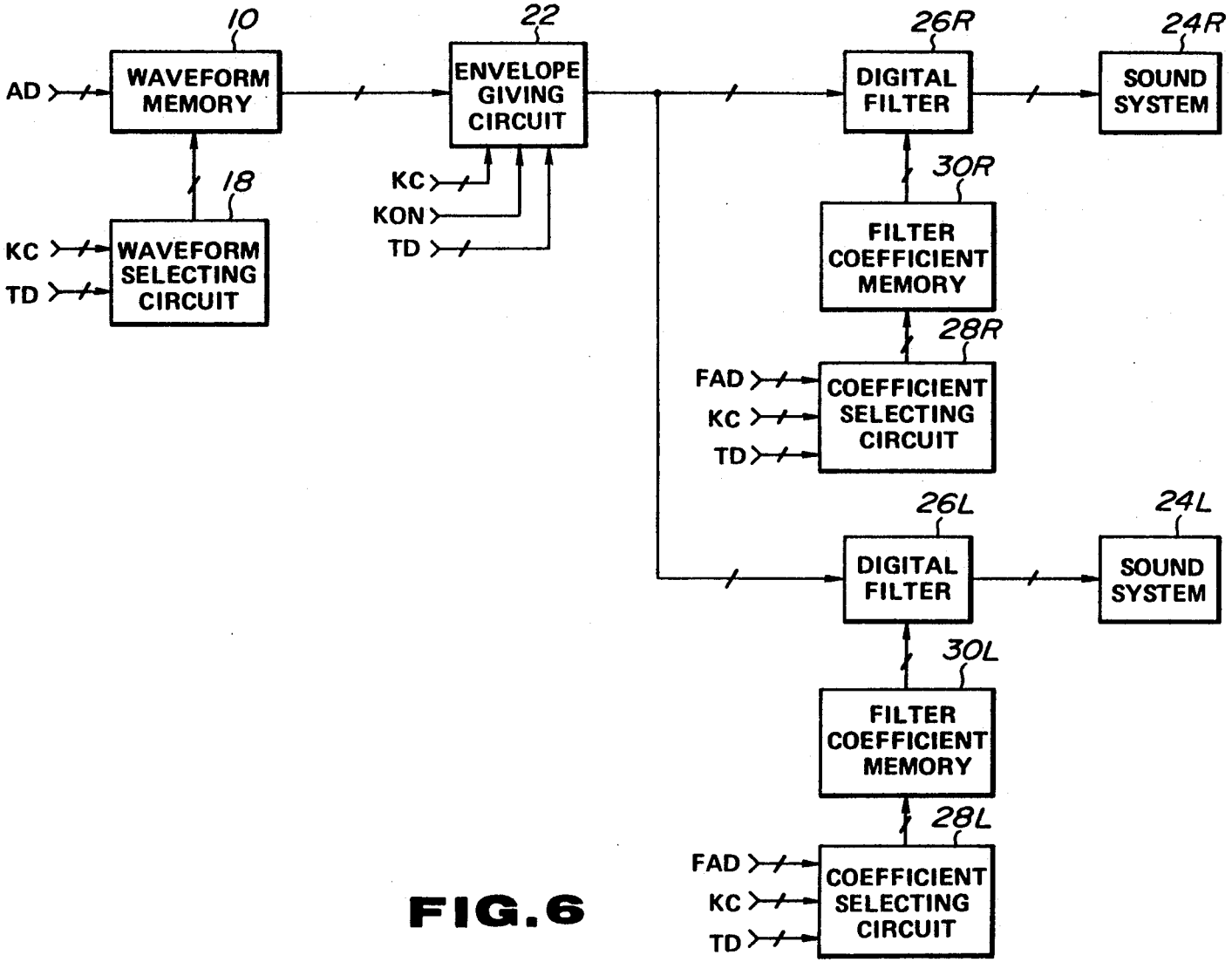
FIG. 6 is a block diagram showing another example of a stereophonic effect giving portion.

[E] Another Example of Stereophonic Effect Giving Portion (FIG. 6)

FIG. 6 shows another example of the stereophonic effect giving portion. In FIG. 6, parts identical to those shown in FIG. 1 are designated by the same numerals, hence, detailed description thereof will be omitted.

The features of the circuit shown in FIG. 6 are that a digital filter 26R is arranged between the envelope giving circuit 22 and the sound system 24R while a digital filter 26L is arranged between the envelope giving circuit 22 and the sound system 24L. The filter coefficients are supplied to the digital filter 26R from the filter coefficient memory 30R which is controlled by the coefficient selecting circuit 28R, while the filter coefficients are supplied to the digital filter 26L from the filter coefficient memory 30L which is controlled by the coefficient selecting circuit 28L. The coefficient selecting circuits 28R and 28L work similar to the coefficient selecting circuit 28 shown in FIG. 1. In addition, the filter coefficient memories 30R and 30L are identical to the filter coefficient memory 30 shown in FIG. 1.

The data different from that in FIG. 1 are stored in the waveform memory 10, the filter coefficient memories 30R and 30L shown in FIG. 6. As the unit for generating such data to be stored, it is possible to use the units shown in FIGS. 7 and 8.

Figure 7:
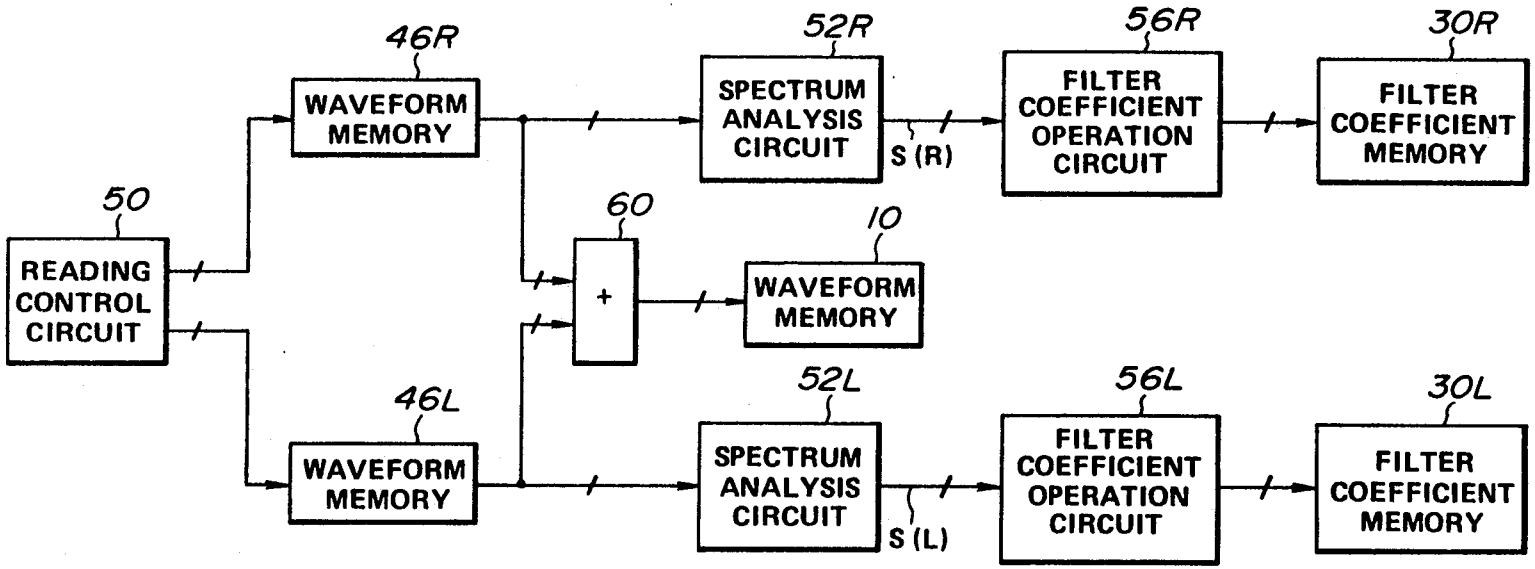
FIGS. 7 and 8 are block diagrams showing different examples of data generating units each used in the stereophonic effect giving portion shown in FIG. 6.

[F] One Example of Data Generating Unit (FIG. 7)

In the data generating unit shown in FIG. 7, the waveform memories 46R and 46L, the reading control circuit 50, the spectrum analysis circuits 52R and 52L are similar to those shown in FIG. 3.

An adder circuit 60 adds the waveform data (corresponding to the right pick-up tone) read from the waveform memory 46R to the waveform data (corresponding &o the left pick-up tone) read from the waveform memory 46L by every corresponding sample point. Through this adding operation, it is possible to obtain combined waveform data of left and right pick-up tones, which are written into the waveform memory 10. Similar to the case described in FIG. 2, the data actually written into the waveform memory 10 are the waveform data of N frames $C_l$ to $C_N$ in this case.

A filter coefficient operation circuit 56R calculates out the filter coefficients based on the spectrum analysis output S(R) outputted from the spectrum analysis circuit 52R. These calculated filter coefficients are written into the filter coefficient memory 30. On the other hand, a filter coefficient operation circuit 56L calculates out the filter coefficients based on the spectrum analysis output S(L) outputted from the spectrum analysis circuit 52L, and the calculated filter coefficients are written into the filter coefficient memory 30L.

By effecting the spectrum analysis and filter coefficient operation on the left and right pick-up tone waveforms by every frame, the filter coefficient memory 30R stores the filter coefficients of N frames concerning the right pick-up tone waveform, while the filter coefficient memory 30L stores the filter coefficients of N frames concerning the left pick-up tone waveform. Such filter coefficient storing process is performed by each combined waveform data to be stored in the waveform memory 10.

Thereafter, the waveform memory 10, the filter coefficient memories 30R and 30L which store &he data as described above are used and applied to the circuit shown in FIG. 6. When this circuit shown in FIG. 6 is operated, the spectrum distribution corresponding to the right pick-up tone can be obtained at output side of the digital filter 26R, while another spectrum distribution corresponding to the left pick-up tone can be obtained at output side of the digital filter 26L. Therefore, the musical tones generated from the sound systems 24R and 24L can have the stereophonic effect.

Figure 8:
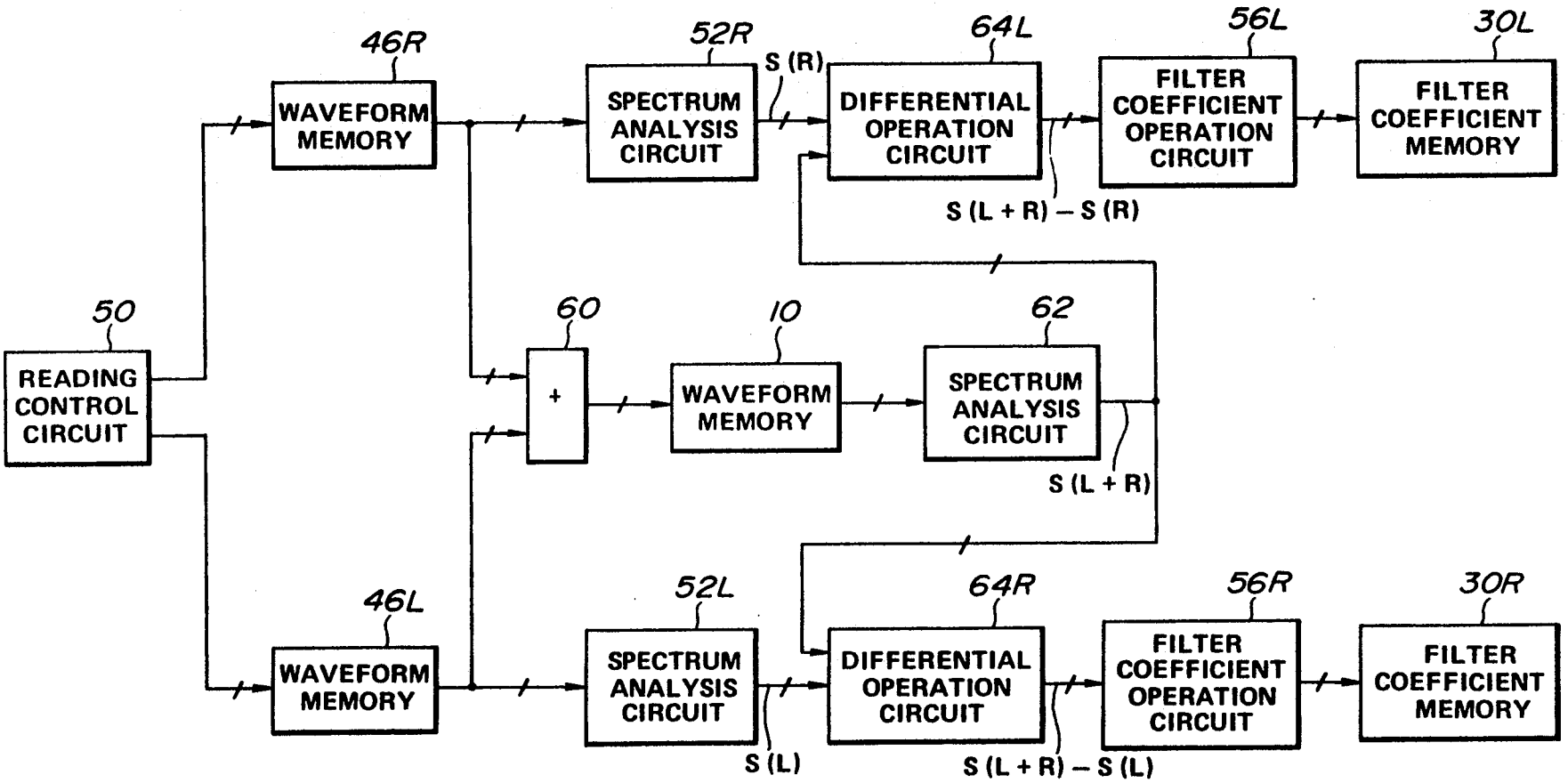

[G] Another Example of Data Generating Unit (FIG. 8)

In the data generating unit shown in FIG. 8, parts similar to those shown in FIG. 7 will be designated by the same numerals.

The data generating unit shown in FIG. 8 is different from that shown in FIG. 7 in that a spectrum analysis circuit 62, differential operation circuits 64L and 64R are provided. This spectrum analysis circuit 62 effects the spectrum analysis on the inputted waveform data (indicative of the combined waveform of the left and right pick-up tones), the differential operation circuit 64L subtracts the spectrum analysis output S(R) of the spectrum analysis circuit 52R from the spectrum analysis output S(L+R) of the spectrum analysis circuit 62, and the differential operation circuit 64R subtracts the spectrum analysis output S(L) of the spectrum analysis circuit 52L from the above spectrum analysis output S(L+R). In addition, the filter coefficient operation circuit 56L calculates out the filter coefficient based on output S(L+R)-S(R) of the differential operation circuit 64L, and then the calculated filter coefficient is written in the filter coefficient memory 30L. On the other hand, the filter coefficient operation circuit 56R calculates out the filter coefficient based on output S(L+R)-S(L) of the differential operation circuit 64R, and then the calculated filter coefficient is written in the filter coefficient memory 30R. The other constitution in the unit shown in FIG. 8 is similar to that in the unit shown in FIG. 7.

Figure 9:
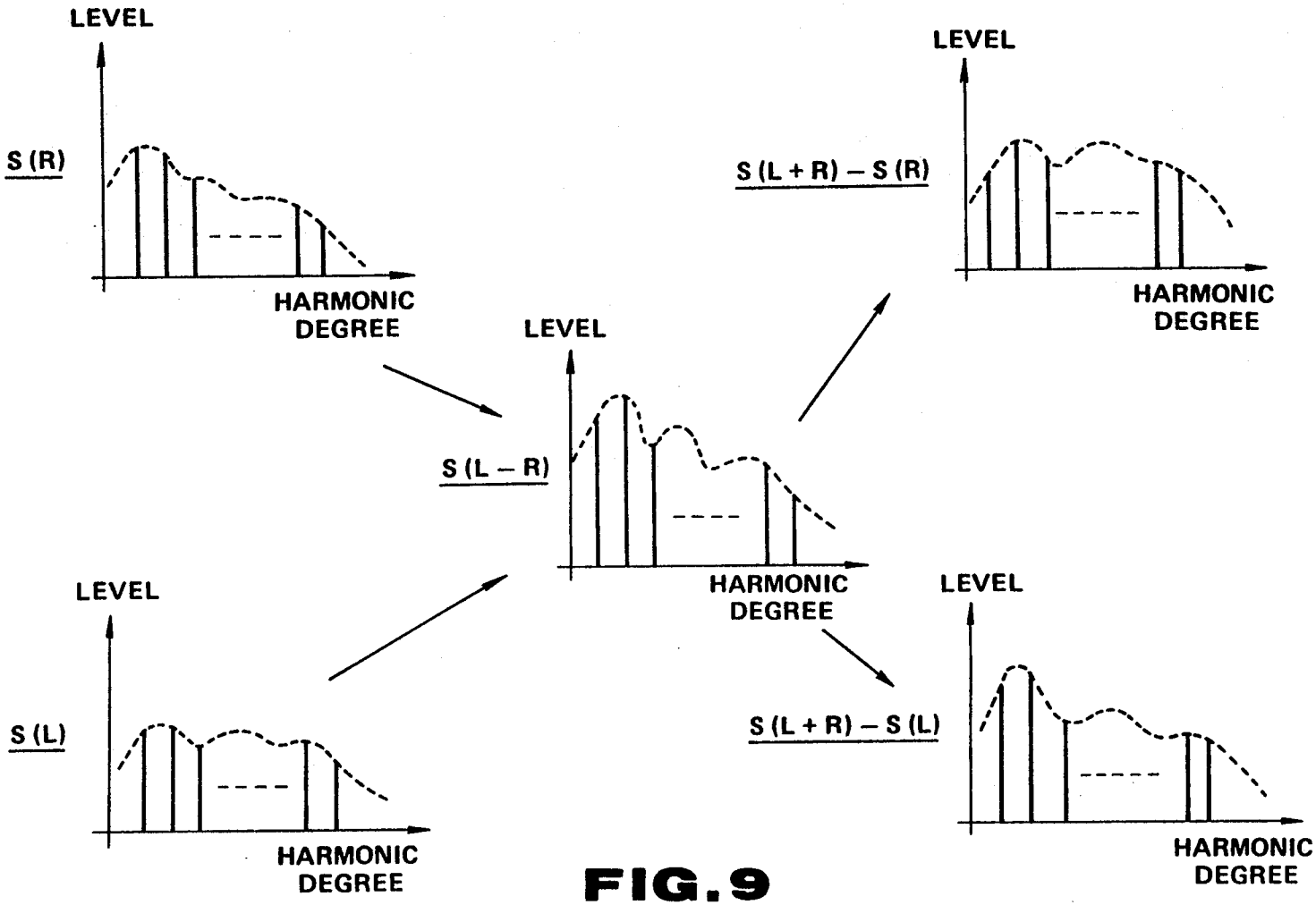
FIG. 9 shows spectrum diagrams representing an example of spectrum analysis of one frame in the data generating unit shown in FIG. 8.

FIG. 9 shows an example of spectrum analysis of one frame in the unit shown in FIG. 8. The output S(L+R) of the spectrum analysis circuit 62 designates the spectrum distribution corresponding to the sum of the spectrum distribution indicated by the output S(L) of left pick-up tone and the spectrum distribution indicated by the output S(R) of right pick-up tone. In addition, the output S(L+R)-S(R) of the differential operation circuit 64L designates the spectrum distribution approximately identical to the spectrum distribution indicated by the output S(L) of left pick-up tone, while the output S(L+R)-S(L) of the differential operation circuit 64R designates the spectrum distribution approximately identical to the spectrum distribution indicated by the output S(R) of right pick-up tone.

Therefore, when the circuit shown in FIG. 6 is operated by use of the waveform memory 10, the filter coefficient memories 30R and 30L in which respective data are stored by the unit shown in FIG. 8, the musical tones generated from the sound systems 24R and 24L can perform the stereophonic effect similar to the case where the data are stored in the above memories by the unit shown in FIG. 7.

[H] Modified Example

The present invention is not limited to the above-mentioned embodiments, so that it is possible to enforce the present invention by several modifications. For example, the following modifications can be considered:

(1) As the method for storing and reading the musical tone waveform, the method disclosed in Japanese Patent Laid-Open Publication No. 60-147793 can be applied to the present invention, for example. In this case, the waveform memory stores plural cycle waveforms of attack portion and continuing segment waveforms (i.e., partial waveforms). After plural cycle waveforms of attack portion are read out, the segment waveforms are read out with executing smooth interpolation.

(2) As the method for recording and reproducing the musical tones, some data compression methods can be applied to the present invention. For example, it is possible to adopt the Differential Pulse Code Modulation (DPCM) method, Adaptive Differential Pulse Code Modulation (ADPCM) method, Delta Modulation (DM) method, Adaptive Delta Modulation (ADM) method, Linear Predictive Coding (LPC) method and the like. Or, it is possible to adopt the combined method of some of above methods, such as the combined method of LPC and ADPCM methods, for example.

(3) As the method for controlling touch response and key scaling, it is possible to adopt the method disclosed in Japanese Patent Laid-Open Publication No. 60-52895 in which the data read from the waveform memory are processed by the digital filter or another method disclosed in Japanese Patent Laid-Open Publication No. 60-55398 in which combining ratio between two data respectively read from two waveform memories are controlled.

(4) In the present embodiments, the waveform data selected by the waveform selecting circuit 18 are read out in response to the address signal from the address generating circuit 20. However, it is possible to modify the address generating circuit 20 to have the function of waveform selecting circuit 18.

(5) The present invention can be applied to single tone electronic musical instrument, sampling electronic musical instrument, rhythm electronic musical instrument and the like.

(6) The present embodiments relate to the case where the tone color is represented by the piano tone. However, it is possible to enforce the present invention by using other tone colors.

(7) The filter coefficient is varied in lapse of time in the present embodiments. However, it is possible to select and use one representative filter coefficient.

(8) The number of sound systems is not limited to two sound systems for left and right pick-up tones. It is possible to provide further more sound systems.

(9) It is possible to combine the musical tone signals of left and right channels so as not to damage the stereophonic effect.

(10) The frame change-over control is performed by use of the address signal in the present embodiments. However, it is possible to perform this frame change-over control by use of time information.

Above is description of preferred embodiments. This invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone generating apparatus comprising:

(a) musical tone signal generating means for generating a musical tone signal; and (b) stereophonic effect imparting means for receiving the musical tone signal and generating left and right musical tones having different frequency characteristics to thereby provide a stereophonic effect, the stereophonic effect imparting means including digital filter means for receiving the musical tone signal and filtering it in the audible frequency range to provide at least one of the left and right musical tones.

2. A musical tone generating apparatus according to claim 1 wherein a filter coefficient of said digital filter means is selected so that the frequency characteristic of said left musical tone will be different from that of said right musical tone.

3. A musical tone generating apparatus according to claim 2 wherein spectrum analysis is effected on a waveform corresponding to said musical tone signal during a filter coefficient determining operation to thereby obtain a spectrum analysis output, wherein said filter coefficient of said digital filter means is generated based on said spectrum analysis output.

4. A musical tone generating apparatus according to claim 3 wherein said waveform corresponding to said musical tone signal is divided into plural frames and wherein said spectrum analysis is effected on each frame of said waveform to thereby determine said filter coefficient for each frame.

5. A musical tone generating apparatus according to claim 1 wherein said digital filter means comprises:

a digital filter filter coefficient memory means for pre-storing several kinds of filter coefficients and selecting means for selecting a desirable filter coefficient from the pre-stored filter coefficients to thereby supply the selected filter coefficient to said digital filter.

6. A musical tone generating apparatus as defined in claim 1 wherein said musical tone signal generating means comprises waveform memory means for storing several kinds of waveform data representative of musical tones of acoustic musical instruments, wherein said musical tone signal is generated in response to said waveform data.

7. A musical tone generating apparatus according to claim 6 wherein said stereophonic effect imparting means comprises:

(a) envelope giving means for giving a desirable amplitude envelope to said waveform data read from said waveform memory means, said envelope giving means being provided before said digital filter means; and (b) left and right sound systems for generating left and right musical tones respectively based on said waveform data outputted from said envelope giving means, (c) wherein said digital filter means is arranged just before at least one of said sound systems, said digital filter means controlling said waveform data from said envelope giving means to be inputted to at least one of said sound systems so that frequency characteristics of said left musical tone will be different from that of said right musical tone.

8. A musical tone generating apparatus comprising:

(a) musical tone signal generating means for generating a musical tone signal;

(b) first channel means for generating a first musical tone based on said musical tone signal;

(c) digital filter means for effecting a digital-filtering operation on said musical tone signal in the audible frequency range based on a filter coefficient; and (d) second channel means for generating a second musical tone based on an output of said digital filter means, whereby frequency characteristics of said first musical tone are different from that of said second musical tone in the audible frequency range.

9. A musical tone generating apparatus according to claim 8 wherein said filter coefficient is determined by effecting spectrum analysis respectively on left and right waveforms of left and right sounds which are picked up from a musical instrument by use of stereophonic recording to thereby obtain left and right spectrum analysis outputs wherein said filter coefficient is determined based on the difference between said left and right spectrum analysis outputs.

10. A musical tone generating apparatus comprising:

(a) musical tone signal generating means for generating a musical tone signal;

(b) digital filter means including first and second digital filters each effecting a specific digital-filtering operation on said musical tone signal in the audible frequency range, each of said first and second digital filters having a different filter coefficient;

(c) first channel means for generating a first musical tone based on an output of said first digital filter; and (d) second channel means for generating a second musical tone based on an output of said second digital filter, whereby frequency characteristics of said first musical tone are different from that of said second musical tone.

11. A musical tone generating apparatus according to claim 8 or 10 further comprising filter coefficient memory means for pre-storing several kinds of filter coefficients and selecting means for selecting a desirable filter coefficient from said several kinds of filter coefficients to thereby supply a selected filter coefficient to said digital filter means.

12. A musical tone generating apparatus as defined in claim 8 or 10 wherein said musical tone signal generating means comprises waveform memory means for storing several kinds of waveform data representative of musical tones of acoustic musical instruments, wherein said musical tone signal is generated in response to said waveform data.

13. A musical tone generating apparatus according to claim 10 wherein said filter coefficients are determined by effecting spectrum analysis respectively on left and right waveforms of left and right sounds which are picked up from a musical instrument by use of stereophonic recording to thereby obtain left and right spectrum analysis outputs, wherein a first filter coefficient of said first digital filter is determined based on said left spectrum analysis output and a second filter coefficient of said second digital filter is determined based on said right spectrum analysis output.

14. A stereophonic effect imparting method for an electronic musical instrument comprising steps of:

reproducing two-channel musical tones which were recorded in advance by use of a stereophonic recording/reproduction system, producing first and second waveform data based on said two-channel musical tones to be reproduced, performing spectrum analysis on at least one of said first and second waveform data, determining a filter coefficient based on the result of the spectrum analysis, effecting a digital-filtering operation on said first waveform data by use of said filter coefficient to thereby output filtered waveform data, and generating first and second musical tones based on said first waveform data and said filtered waveform data, respectively, thereby to provide a stereophonic effect.

15. A stereophonic effect imparting method for an electronic musical instrument according to claim 14 wherein said coefficient is determined such that the spectrum of said filtered waveform data is set approximately equal to that of said second waveform data.

16. A stereophonic effect imparting method for an electronic musical instrument according to claim 14 wherein spectrum analysis is performed on both the first and second waveform data and wherein said coefficient is determined based on a difference between spectrums of said first and second waveform data.

17. A stereophonic effect imparting method for an electronic musical instrument comprising steps of:

reproducing two-channel musical tones which were recorded in advance by use of a stereophonic recording/reproduction system, producing first and second waveform data based on said two-channel musical tones to be reproduced, performing spectrum analysis of said first and second waveform data, determining first and second coefficients based on an analysis result of the spectrums of said first and second waveform data, effecting digital-filtering operations respectively on said first and second waveform data by use of said first and second coefficients to thereby output first and second filtered-waveform data, and generating musical tones to which a stereophonic effect is imparted based on said first and second filtered-waveform data.

18. A stereophonic effect imparting method for an electronic musical instrument comprising steps of:

reproducing two-channel musical tones which were recorded in advance by use of a stereophonic recording/reproduction system;

producing first and second waveform data based on said two-channel musical tones to be reproduced;

adding said first and second waveform data together to thereby produce third waveform data having an intermediate spectral content between spectrums of said first and second waveform data;

performing spectrum analysis of said first, second and third waveform data;

determining a first coefficient based on a difference between the spectrums of said first and third waveform data, and determining a second coefficient based on a difference between the spectrums of said second and third waveform data;

effecting digital-filtering operations respectively on said first and second waveform data by use of said first and second coefficients to thereby output first and second filtered-waveform data; and generating musical tones to which a stereophonic effect is imparted based on said first and second filtered-waveform data.

* * * * *